US005821866A

United States Patent [19]

Bernal et al.

[11] Patent Number: 5,821,866

[45] **Date of Patent: *Oct. 13, 1998**

[54] SELF-DIAGNOSING SMOKE DETECTOR ASSEMBLY

[75] Inventors: Brian Andrew Bernal; Robert Gerard Fischette, both of Portland, Oreg.; Kirk Rodney Johnson, Vancouver; Douglas Henry Marman, Ridgefield, both of Wash.

[73] Assignee: SLC Technologies, Inc., Tualatin, Oreg.

[ * ] Notice: The term of this patent shall not extend beyond the expiration date of Pat. No. 5,546,074.

[21] Appl. No.: 696,304

[22] Filed: Aug. 13, 1996

Related U.S. Application Data

[62] Division of Ser. No. 110,131, Aug. 19, 1993, Pat. No. 5,546,074.

[51] Int. Cl.[6] ..... G08B 17/107

[52] U.S. Cl. ..... 340/630; 340/628; 340/693; 250/574

[58] Field of Search ..... 340/628, 629, 340/630, 693; 250/573, 574

[56] References Cited

U.S. PATENT DOCUMENTS

| | | | |
|---|---|---|---|
| 2,473,314 | 6/1949 | Toulon | 177/311 |
| 3,143,161 | 8/1964 | Graves et al. | 158/28 |
| 3,530,450 | 9/1970 | Walthard et al. | 340/214 |
| 3,543,260 | 11/1970 | Engh | 340/228 |
| 3,657,713 | 4/1972 | Sasaki et al. | 340/214 |

(List continued on next page.)

FOREIGN PATENT DOCUMENTS

| | | | |
|---|---|---|---|
| 590527 | 8/1977 | Switzerland | G08B 17/107 |
| 2203238 | 10/1988 | United Kingdom | G08B 17/107 |

OTHER PUBLICATIONS

Fig. 1 Diagram of Apollo Fire Detectors Series 60 and 95 Smoke Detector Housings, 1991.

Fig. 2 Diagram of ESL Model 447 Smoke Detector Housing, 1991.

Fig. 3 Diagram of ESL Model 320 Smoke Detector Chamber, 1981.

Fig. 4 Diagram of ESL Model 445 Smoke Detector Housing, 1985.

Fig. 5 Diagram of ESL Model 611 Smoke Detector Housing, 1990.

(List continued on next page.)

*Primary Examiner*—Daniel J. Wu
*Attorney, Agent, or Firm*—Stoel Rives LLP

[57] ABSTRACT

A self-contained smoke detector system has internal self-diagnostic capabilities and accepts a replacement smoke intake canopy (14) without a need for recalibration. The system includes a microprocessor-based self-diagnostic circuit (200) that periodically checks sensitivity of the optical sensor electronics (24, 28) to smoke obscuration level. By setting tolerance limits on the amount of change in voltage measured in clean air, the system can provide an indication of when it has become either under-sensitive or over-sensitive to the ambient smoke obscuration level. An algorithm implemented in software stored in system memory (204) determines whether and provides an indication that for a time (such as 27 hours) the clean air voltage has strayed outside established sensitivity tolerance limits. The replaceable canopy is specially designed with multiple pegs (80) having multi-faceted surfaces (110, 112, 114). The pegs are angularly spaced about the periphery in the interior of the canopy to function as an optical block for external light infiltrating through the porous side surface (64) of the canopy and to minimize spurious light reflections from the interior of the smoke detector system housing (10) toward a light sensor photodiode (28). The pegs are positioned and designed also to form a labyrinth of passageways (116) that permit smoke to flow freely through the interior of the housing.

34 Claims, 10 Drawing Sheets

U.S. PATENT DOCUMENTS

| | | | |
|---|---|---|---|
| 3,678,510 | 7/1972 | Walthard et al. | 340/410 |
| 3,683,372 | 8/1972 | Horn | 340/410 |
| 3,882,477 | 5/1975 | Mueller | 340/237 S |
| 3,928,849 | 12/1975 | Schwarz | 340/410 |
| 4,097,850 | 6/1978 | Conforti | 340/214 |
| 4,099,178 | 7/1978 | Ranney et al. | 340/515 |
| 4,168,438 | 9/1979 | Morisue | 250/574 |
| 4,199,755 | 4/1980 | Tanaka | 340/630 |
| 4,222,046 | 9/1980 | Pinckaers | 340/629 |
| 4,225,791 | 9/1980 | Kompelien | 250/574 |
| 4,232,307 | 11/1980 | Marsocci | 340/515 |
| 4,246,572 | 1/1981 | Larsen | 340/501 |
| 4,302,753 | 11/1981 | Conforti | 340/628 |
| 4,306,230 | 12/1981 | Forss et al. | 340/630 |
| 4,321,466 | 3/1982 | Mallory et al. | 250/574 |
| 4,388,615 | 6/1983 | Ford et al. | 340/516 |
| 4,394,655 | 7/1983 | Wynne et al. | 340/825.36 |
| 4,459,583 | 7/1984 | van der Walt et al. | 340/589 |
| 4,469,953 | 9/1984 | Fujisawa et al. | 250/574 |
| 4,470,047 | 9/1984 | Vogt et al. | 340/825.36 |
| 4,507,653 | 3/1985 | Bayer | 340/539 |
| 4,524,351 | 6/1985 | Kimura et al. | 340/629 |
| 4,595,914 | 6/1986 | Siegel | 340/515 |
| 4,647,786 | 3/1987 | Guttinger et al. | 250/574 |
| 4,672,217 | 6/1987 | Dobrzanski | 250/574 |
| 4,692,750 | 9/1987 | Murakami et al. | 340/630 |
| 4,749,986 | 6/1988 | Otani et al. | 340/587 |
| 4,758,733 | 7/1988 | Mochizuki | 250/574 |
| 4,785,283 | 11/1988 | Yuchi | 340/588 |
| 4,803,469 | 2/1989 | Matsushita | 340/628 |
| 4,823,015 | 4/1989 | Galvin et al. | 340/630 |
| 4,827,247 | 5/1989 | Giffone | 340/630 |
| 4,866,425 | 9/1989 | Lindmark | 340/630 |
| 4,871,999 | 10/1989 | Ishii et al. | 340/628 |
| 4,893,005 | 1/1990 | Stiebel | 250/221 |
| 5,021,677 | 6/1991 | Igarashi et al. | 340/630 |
| 5,083,107 | 1/1992 | Takahashi et al. | 340/506 |
| 5,117,219 | 5/1992 | Tice et al. | 340/506 |
| 5,155,468 | 10/1992 | Stanley et al. | 340/588 |
| 5,172,096 | 12/1992 | Tice et al. | 340/588 |
| 5,400,014 | 3/1995 | Behlke et al. | 340/630 |
| 5,440,293 | 8/1995 | Tice et al. | 340/506 |
| 5,473,314 | 12/1995 | Mochizuki et al. | 340/630 |
| 5,543,777 | 8/1996 | Vane et al. | 340/514 |
| 5,546,074 | 8/1996 | Bernal et al. | 340/628 |
| 5,552,765 | 9/1996 | Vane et al. | 340/515 |

OTHER PUBLICATIONS

Figs. 6A and 6B Diagrams of Apollo Fire Detectors Model 800 Smoke Detector Chamber. 1988.

Fig. 7 Diagram of BRK Notifier Model SDX–551 Smoke Detector Chamber, 1984.

Motorola Semiconductor Technical Data for MC 145010, *Motorola CMOS Application–Specific Digital–Analog Integrated Circuits*, 1991, pp. 7–21—7–30.

Motorola Semiconductor Technical Data for MC 145011, *Motorola CMOS Application–Specific Digital–Analog Integrated Circuits*, 1991, pp. 7–31—7–40.

The Sensicheck Principle: A New Concept in Fire Detection, Aritech, 1989.

Technical Bulletin ESL Series 600 Fire Detectors, 1989 (25 pages).

First Inertia Switch, Grand Blanc, Michigan, "Fireray Optical Beam Smoke Detector Application & Installation Guide".

Technical Bulletin 2222–T81 ESL Series 440 Photoelectronic Smoke Detectors Product Guide, Jan. 1984.

Sensicheck, Aritech, 1989.

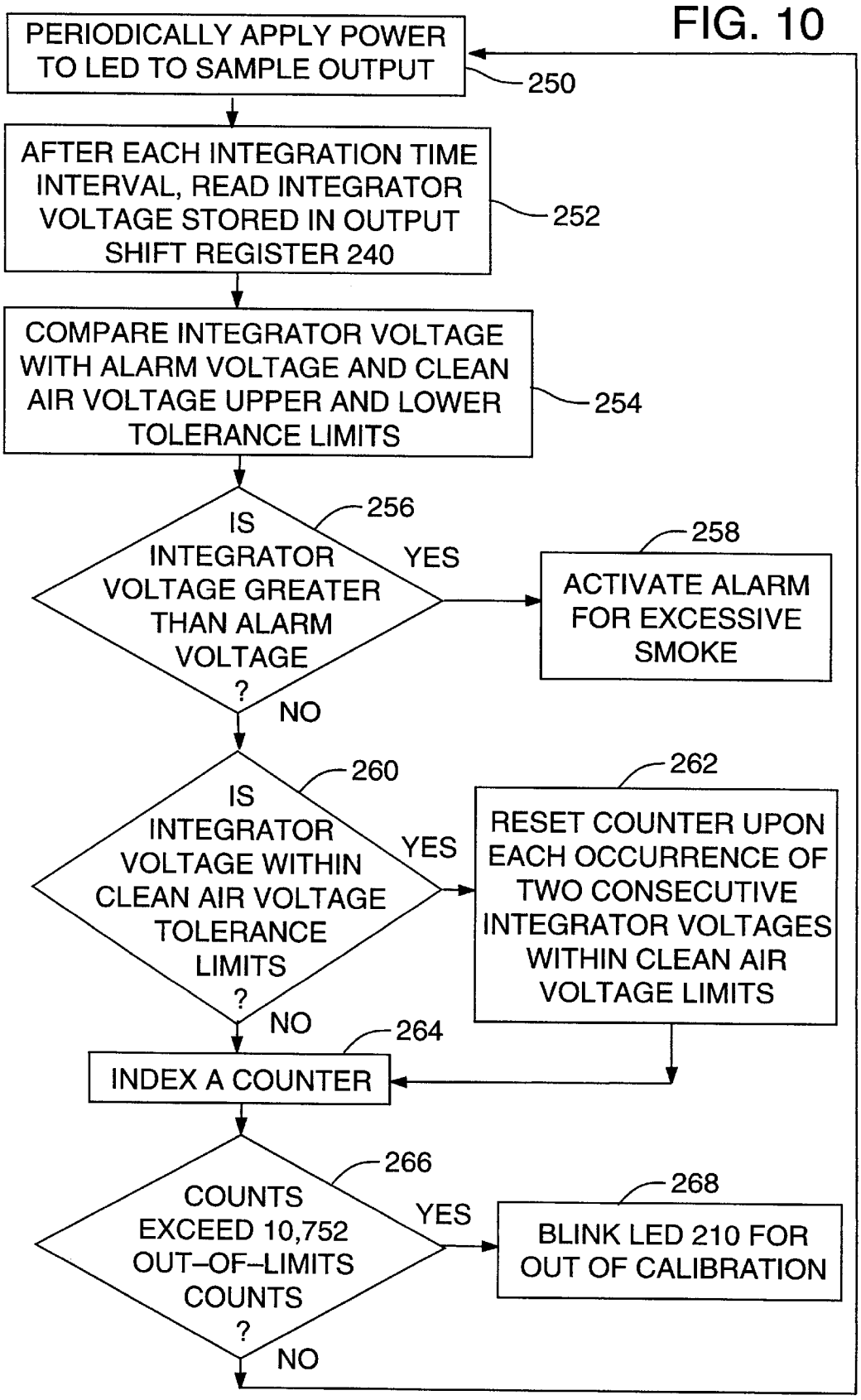
FIG. 10
PERIODICALLY APPLY POWER TO LED TO SAMPLE OUTPUT
250
AFTER EACH INTEGRATION TIME INTERVAL, READ INTEGRATOR VOLTAGE STORED IN OUTPUT SHIFT REGISTER 240
252
COMPARE INTEGRATOR VOLTAGE WITH ALARM VOLTAGE AND CLEAN AIR VOLTAGE UPPER AND LOWER TOLERANCE LIMITS
254
IS INTEGRATOR VOLTAGE GREATER THAN ALARM VOLTAGE ?
256
YES
ACTIVATE ALARM FOR EXCESSIVE SMOKE
258
NO
IS INTEGRATOR VOLTAGE WITHIN CLEAN AIR VOLTAGE TOLERANCE LIMITS ?
260
YES
RESET COUNTER UPON EACH OCCURRENCE OF TWO CONSECUTIVE INTEGRATOR VOLTAGES WITHIN CLEAN AIR VOLTAGE LIMITS
262
NO
INDEX A COUNTER
264
COUNTS EXCEED 10,752 OUT–OF–LIMITS COUNTS ?
266
YES
BLINK LED 210 FOR OUT OF CALIBRATION
268
NO

SELF-DIAGNOSING SMOKE DETECTOR ASSEMBLY

This is a division of application Ser. No. 08/110,131, filed Aug. 19, 1993.

TECHNICAL FIELD

The present invention relates to smoke detector systems and, in particular, to a smoke detector system that has internal self-diagnostic capabilities and needs no recalibration upon replacement of its smoke intake canopy.

BACKGROUND OF THE INVENTION

A photoelectric smoke detector system measures the ambient smoke conditions of a confined space and activates an alarm in response to the presence of unacceptably high amounts of smoke. This is accomplished by installing in a housing covered by a smoke intake canopy a light-emitting device ("emitter") and a light sensor ("sensor") positioned in proximity to measure the amount of light transmitted between them.

A first type of smoke detector system positions the emitter and sensor so that their lines of sight are collinear. The presence of increasing amounts of smoke increases the attenuation of light passing between the emitter and the sensor. Whenever the amount of light striking the sensor drops below a minimum threshold, the system activates an alarm.

A second type of smoke detector system positions the emitter and sensor so that their lines of sight are offset at a sufficiently large angle that very little light propagating from the emitter directly strikes the sensor. The presence of increasing amounts of smoke increases the amount of light scattered toward and striking the sensor. Whenever the amount of light striking the sensor increases above a maximum threshold, the system activates an alarm.

Because they cooperate to measure the presence of light and determine whether it exceeds a threshold amount, the emitter and sensor need initial calibration and periodic testing to ensure their optical response characteristics are within the nominal limits specified. Currently available smoke detector systems suffer from the disadvantage of requiring periodic inspection of system hardware and manual adjustment of electrical components to carry out a calibration sequence.

The canopy covering the emitter and sensor is an important hardware component that has two competing functions to carry out. The canopy must act as an optical block for outside light but permit adequate smoke particle intake and flow into the interior of the canopy for interaction with the emitter and sensor. The canopy must also be constructed to prevent the entry of insects and dust, both of which can affect the optical response of the system and its ability to respond to a valid alarm condition. The interior of the canopy should be designed so that secondary reflections of light occurring within the canopy are either directed away from the sensor and out of the canopy or absorbed before they can reach the sensor.

SUMMARY OF THE INVENTION

An object of the invention is, therefore, to provide a smoke detector system that is capable of performing self-diagnostic functions to determine whether it is within its calibration limits and thereby to eliminate a need for periodic manual calibration testing.

Another object of the invention is to provide such a system that accepts a replacement smoke intake canopy without requiring recalibration.

A further object of the invention is to provide for such a system a replaceable smoke intake canopy that functions as an optical block for externally infiltrating and internally reflected light and that minimally impedes the flow of smoke particles to the emitter and sensor.

The present invention is a self-contained smoke detector system that has internal self-diagnostic capabilities and accepts a replacement smoke intake canopy without a need for recalibration. A preferred embodiment includes a light-emitting diode ("LED") as the emitter and a photodiode sensor. The LED and photodiode are positioned and shielded so that the absence of smoke results in the photodiode's receiving virtually no light emitted by the LED and the presence of smoke results in the scattering of light emitted by the LED toward the photodiode.

The system includes a microprocessor-based self-diagnostic circuit that periodically checks the sensitivity of the optical sensor electronics to smoke obscuration level. There is a direct correlation between a change in the clean air voltage output of the photodiode and its sensitivity to the smoke obscuration level. Thus, by setting tolerance limits on the amount of change in voltage measured in clean air, the system can provide an indication of when it has become either under-sensitive or over-sensitive to the ambient smoke obscuration level.

The system samples the amount of smoke present by periodically energizing the LED and then determining the smoke obscuration level. An algorithm implemented in software stored in system memory determines whether for a time (such as 27 hours) the clean air voltage is outside established sensitivity tolerance limits. Upon determination of an under- or over-sensitivity condition, the system provides an indication that a problem exists with the optical sensor electronics.

The LED and photodiode reside in a compact housing having a replaceable smoke intake canopy of preferably cylindrical shape with a porous side surface. The canopy is specially designed with multiple pegs having multi-faceted surfaces. The pegs are angularly spaced about the periphery in the interior of the canopy to function as an optical block for external light infiltrating through the porous side surface of the canopy and to minimize spurious light reflections from the interior of the housing toward the photodiode. This permits the substitution of a replacement canopy of similar design without the need to recalibrate the optical sensor electronics previously calibrated during installation at the factory. The pegs are positioned and designed also to form a labyrinth of passageways that permit smoke to flow freely through the interior of the housing.

Additional objects and advantages of the present invention will be apparent from the following detailed description of a preferred embodiment thereof, which proceeds with reference to the accompanying drawings.

BRIEF DESCRIPTION OF THE DRAWINGS

FIG. 2 is an isometric view of the housing of

FIG. 1 with its replaceable smoke intake canopy and base disassembled to show the placement of the optical components in the base.

FIG. 10 is a flow diagram showing the self-diagnosis steps carried out by the optical sensor electronics shown in FIG. 8.

DETAILED DESCRIPTION OF A PREFERRED EMBODIMENT

Figure 1:
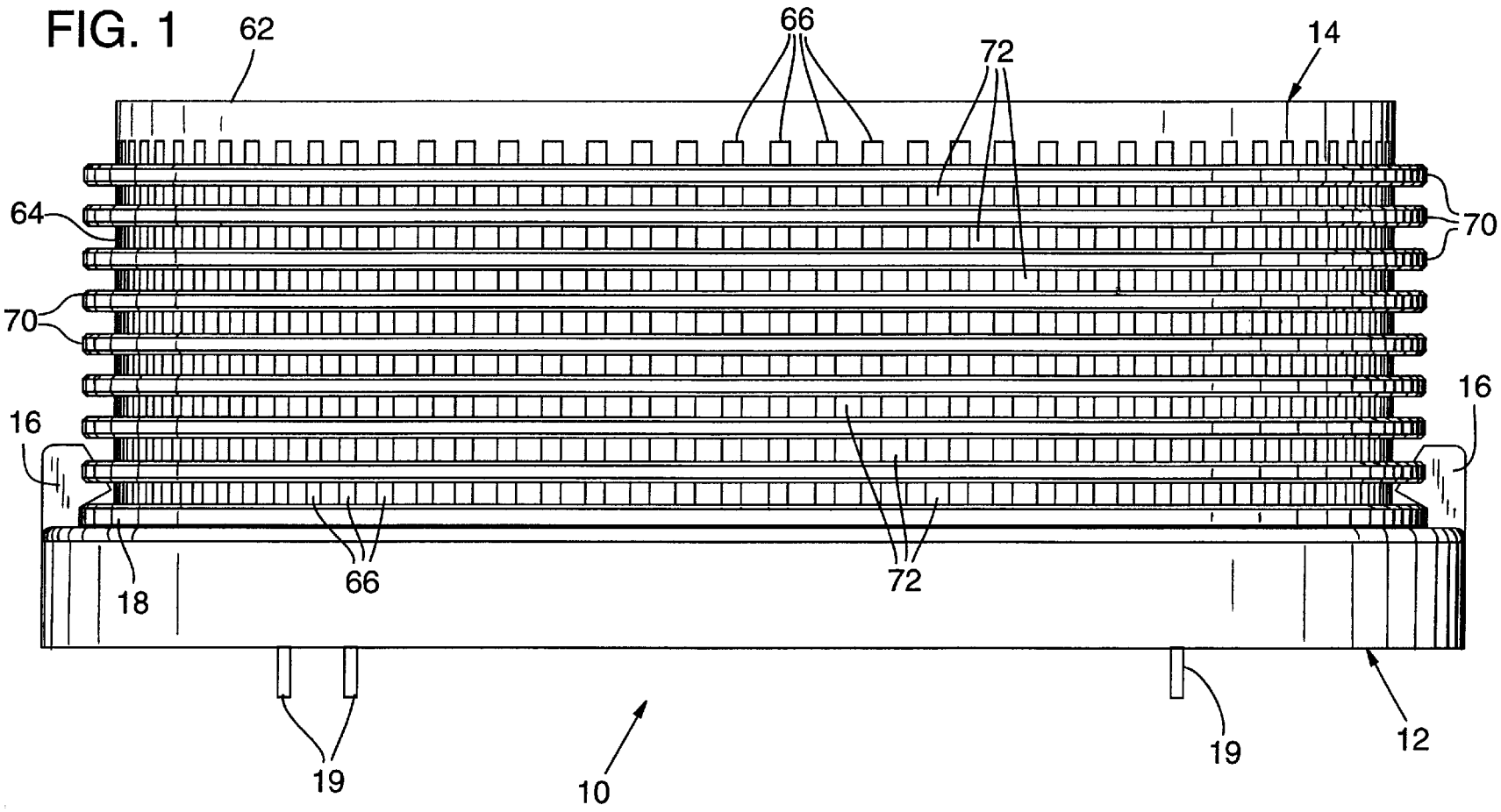
FIG. 1 is a side elevation view of the assembled housing for the smoke detector system of the present invention.

FIGS. 1–5 show a preferred embodiment of a smoke detector system housing 10 that includes a circular base 12 covered by a removable smoke intake canopy 14 of cylindrical shape. Base 12 and canopy 14 are formed of molded plastic whose color is black so as to absorb light incident to it. A pair of diametrically opposed clasps 16 extend from base 12 and fit over a snap ring 18 encircling the rim of canopy 14 to hold it and base 12 together to form a low profile, unitary housing 10. Housing 10 has pins 19 that fit into holes in the surface of a circuit board (not shown) that holds the electronic components of the smoke detector system.

Figure 2:
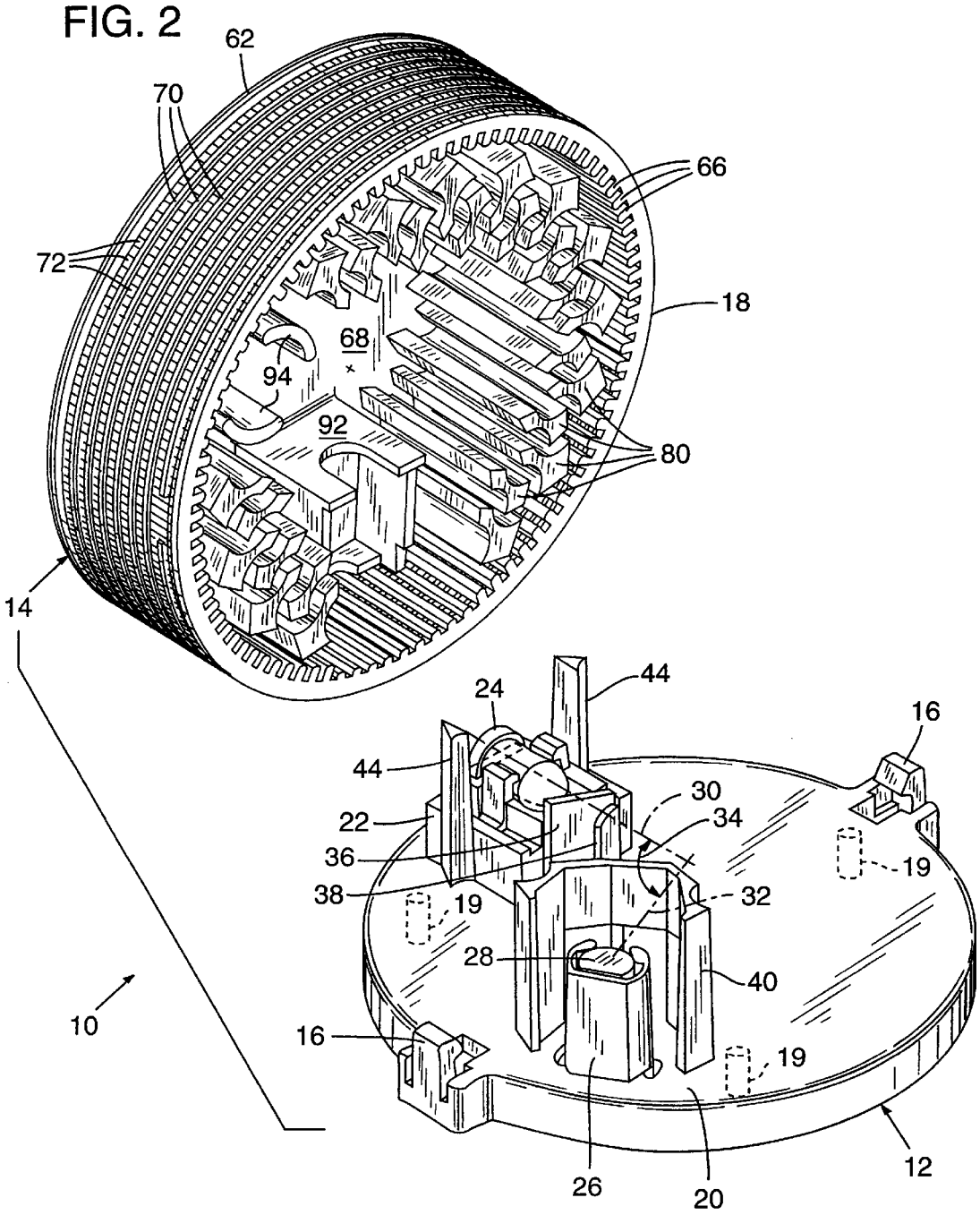
Figure 3:
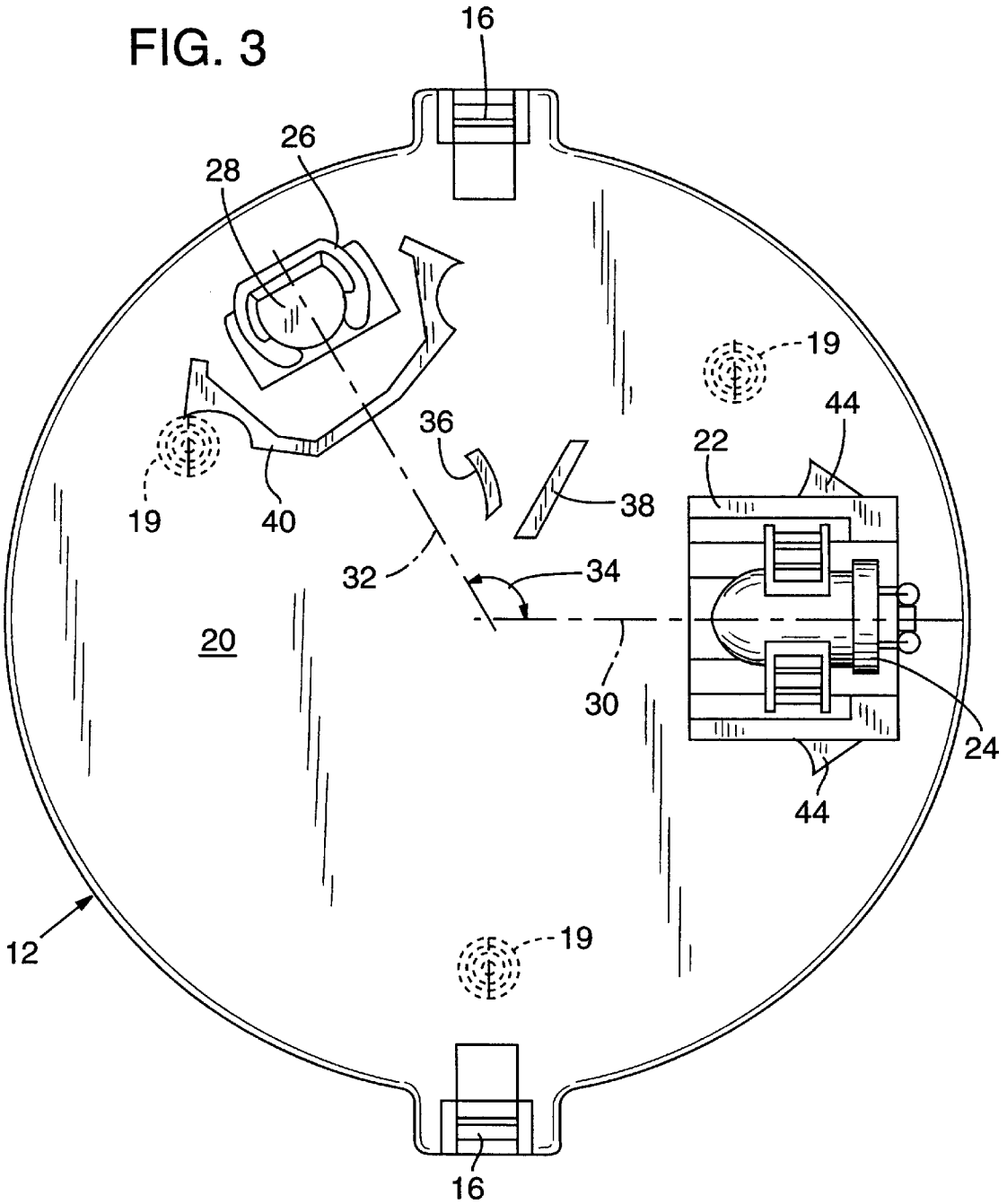
FIG. 3 is plan view of the base shown in FIG. 2.

With particular reference to FIGS. 2 and 3, base 12 has an inner surface 20 that supports an emitter holder 22 for a light-emitting diode (LED) 24 and a sensor holder 26 for a photodiode 28. LED 24 and photodiode 28 are angularly positioned on inner surface 20 near the periphery of base 12 so that the lines of sight 30 and 32 of the respective LED 24 and photodiode 28 intersect to form an obtuse angle 34 whose vertex is near the center of base 12. Angle 34 is preferably about 120° . Light-blocking fins 36 and 38 positioned between LED 24 and photodiode 28 and a light shield 40 covering both sides of photodiode 28 ensure that light emitted by LED 24 in a clean air environment does not reach photodiode 28. Together with light shield 40, a pair of posts 44 extending upwardly from either side of emitter holder 22 guide the positioning of canopy 14 over base 12 during assembly of housing 10.

Figure 4A:
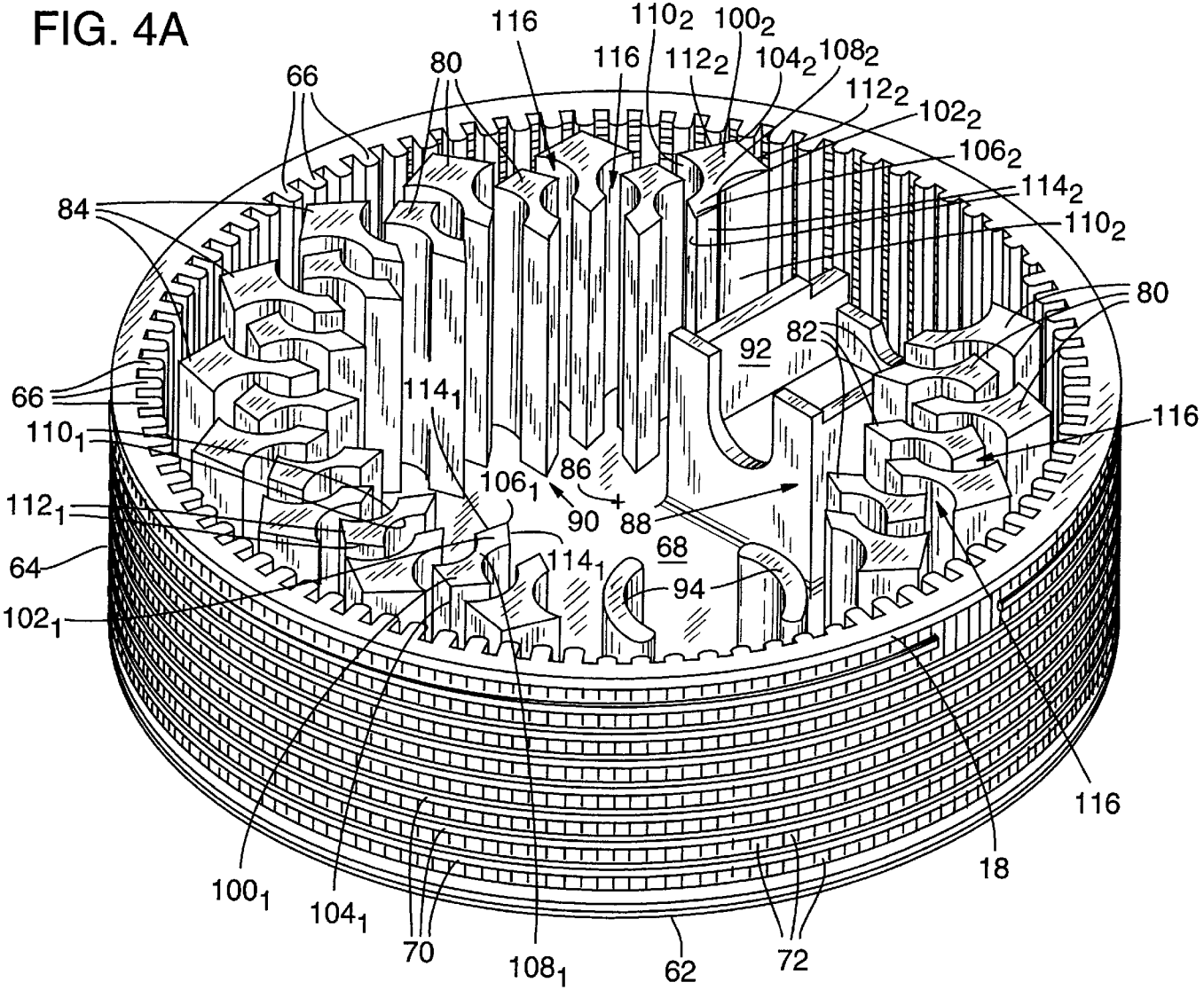
FIGS. 4A and 4B are isometric views taken at different vantage points of the interior of the canopy shown in FIG. 2.
Figure 4B:
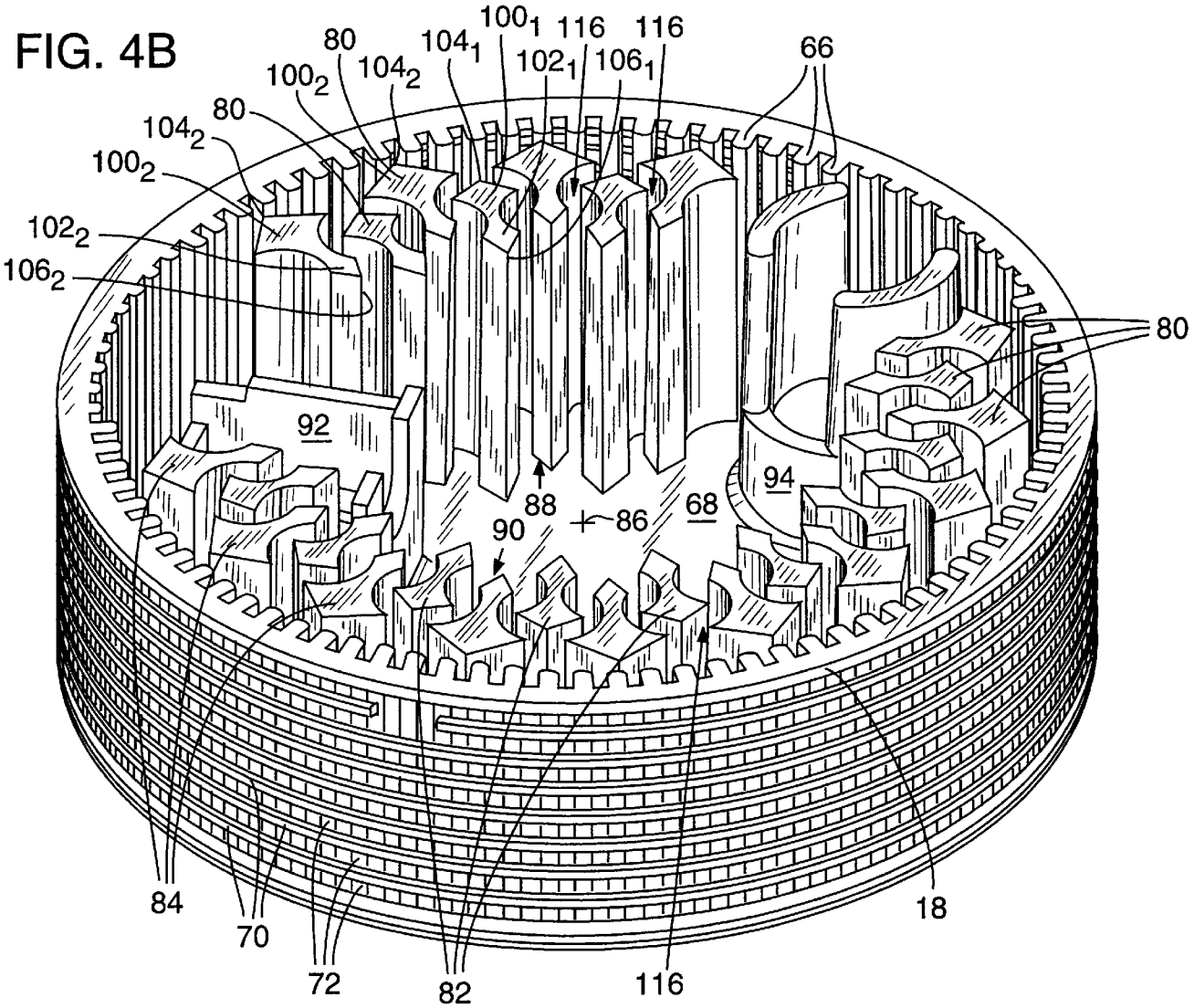
Figure 5:
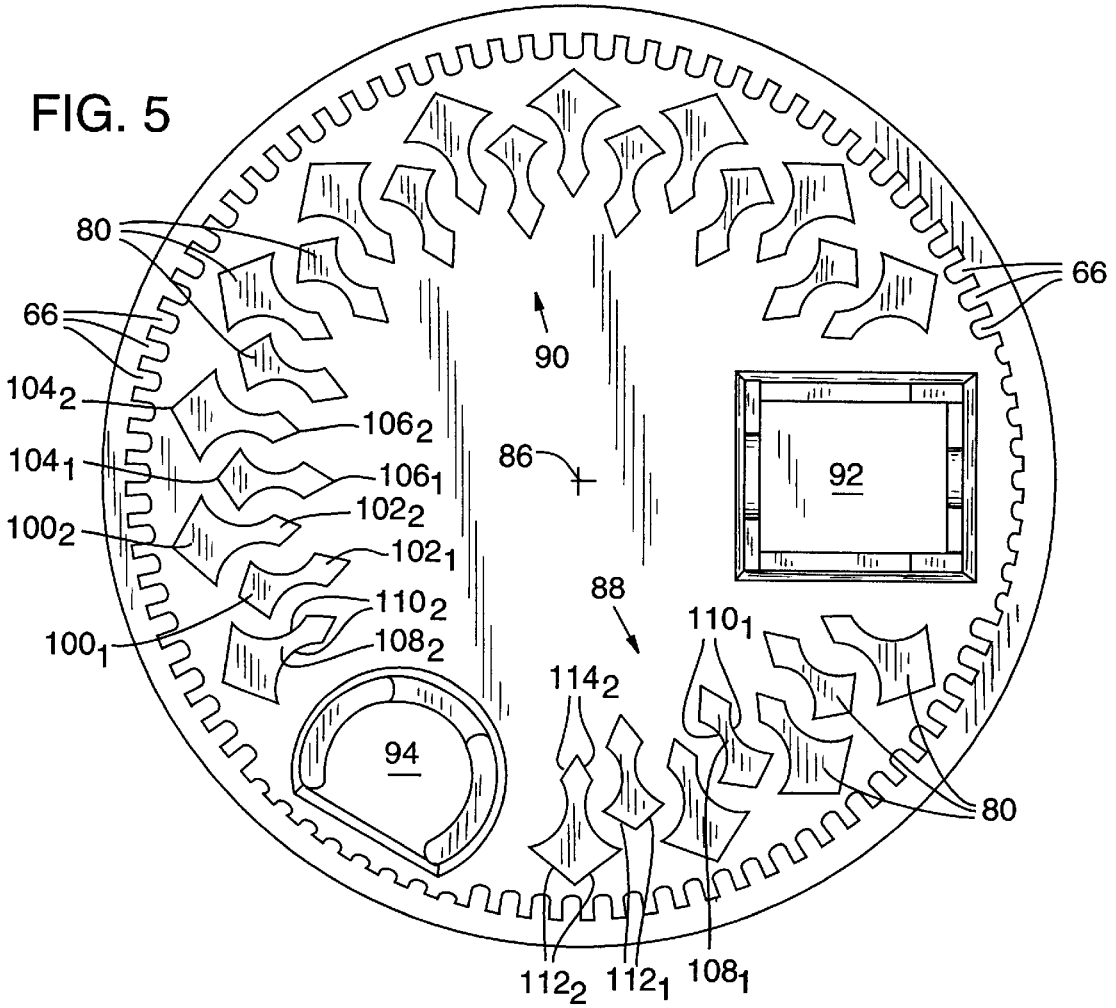
FIG. 5 is a plan view of the interior of the canopy shown in FIG. 2.

With particular reference to FIGS. 4A, 4B, and 5, canopy 14 includes a circular top member 62 from which a porous side member 64 depends to define the periphery and interior of canopy 14 and of the assembled housing 10. The diameter of top member 62 is the same as that of base 12. Side member 64 includes a large number of ribs 66 angularly spaced apart around the periphery of and disposed perpendicularly to the inner surface 68 of top member 62 to define a slitted surface. A set of spaced-apart rings 70 positioned along the lengths of ribs 66 encircle the slitted surface defined by ribs 66 to form a large number of small rectangular apertures 72. The placement of ribs 66 and rings 70 provides side member 64 with a porous surface that serves as a smoke intake filter and a molded-in screen that prevents insects from entering housing 10 and interfering with the operation of LED 24 and photodiode 28.

Apertures 72 are of sufficient size that allows adequate smoke particle intake flow into housing 10. The size of apertures 72 depends upon the angular spacing between adjacent ribs 66 and the number and spacing of rings 70. In a preferred embodiment, a housing 10 having a 5.2 centimeter base and a 1.75 centimeter height has eighty-eight ribs angularly spaced apart by about 4° and nine equidistantly spaced rings 70 to form 0.8 $mm^2$ apertures 72. The ring 70 positioned farthest from top member 62 constitutes snap ring 18.

The interior of canopy 14 contains an array of pegs 80 having multi-faceted surfaces. Pegs 80 are an integral part of canopy 14, being formed during the molding process. Pegs 80 are angularly spaced about the periphery of canopy 14 so that their multi-faceted surfaces can perform several functions. Pegs 80 function as an optical block for external light infiltrating through porous side member 64 of canopy 14, minimize spurious light reflections within the interior of housing 10 toward photodiode 28, and form a labyrinth of passageways for smoke particles to flow freely through the interior of housing 10.

Pegs 80 are preferably arranged in a first group 82 and a second group 84. The pegs 80 of first group 82 are of smaller surface areas and are positioned nearer to center 86 of canopy 14 than are the pegs 80 of second group 84. Thus, adjacent pegs 80 in second group 84 are separated by a recessed peg 80 in first group 82. The pegs 80 of groups 82 and 84 are divided into two sets 88 and 90 that are separated by light shield caps 92 and 94. Caps 92 and 94 mate with the upper surfaces of, respectively, emitter holder 22 of LED 24 and sensor holder 26 of photodiode 28 when housing 10 is assembled. Because of the obtuse angle 34 defined by lines of sight 30 and 32 of LED 24 and photodiode 28, respectively, there are fewer pegs 80 in set 88 than in set 90.

Although the pegs 80 in first group 82 have smaller surface areas than those of the pegs 80 in second group 84, all of pegs 80 are of uniform height measured from top member 62 and have similar profiles. The following description is, therefore, given in general for a peg 80. In the drawings, corresponding features of pegs 80 in first group 82 have the subscript "1" and in the second group 84 have the subscript "2".

Each of pegs 80 is of elongated shape and has a larger pointed head section 100 and a smaller pointed tail section 102 whose respective apex 104 and apex 106 lie along the same radial line extending from center 86 of canopy 14. Apex 104 of head section 100 is positioned nearer to side member 64, and apex 106 of tail section 102 is positioned nearer to center 86 of canopy 14. A medial portion 108 includes concave side surfaces 110 that taper toward the midpoint between apex 104 of head section 100 and apex 106 of tail section 102.

Head section 100 includes flat facets or sides 112 joined at apex 104. The surface areas of sides 112 are selected collectively to block normally incident light entering apertures 72 from passing to the interior of housing 10. In one embodiment, each side $\mathbf{112}_1$ is 2.0 mm in length, and sides $\mathbf{112}_1$ define a 105° angle at apex $\mathbf{104}_1$. Each side $\mathbf{112}_2$ is 3.2 mm in length, and sides $\mathbf{112}_2$ define a 105° angle at apex $\mathbf{104}_2$. Medial portions 108 of the proper length block passage of light not blocked by sides 112. Light shield caps 92 and 94 and holders 22 and 26 block the passage of light in the places where pegs 80 are not present in canopy 14.

Tail section 102 includes flat facets or sides 114 joined at apex 106. The surface areas of sides 114 are selected to direct spurious light reflections occurring within housing 10 away from photodiode 28 and toward side member 62 for either absorption or passage outward through apertures 72. In the same embodiment, each side $\mathbf{114}_1$ is 1.9 mm in length, and sides $\mathbf{114}_1$ define a 60° angle at apex $\mathbf{106}_1$. Each side $\mathbf{114}_2$ is 1.8 mm in length, and sides $\mathbf{114}_2$ define a 75° angle at apex $\mathbf{106}_2$. This function of tail sections 102 allows with the use of different canopies 14 the achievement of very uniform, low ambient level reflected radiation signals toward photodiode 28. Canopy 14 can, therefore, be field replaceable and used as a spare exam in the event of, for example, breakage, excessive dust build-up over apertures 72 causing reduced smoke infiltration, or excessive dust build-up on pegs 80 causing a higher than nominal clean air voltage.

The amount of angular separation of adjacent pegs 80, the positioning of a peg 80 of first group 82 between adjacent pegs 80 of second group 84, and the length of medial portion 108 of pegs 80 define the shape of a labyrinth of passageways 116 through which smoke particles flow to and from apertures 72. It is desirable to provide passageways 116 having as small angular deviations as possible so as to not impede smoke particle flow.

The smoke particles flowing through housing 10 reflect toward photodiode 28 the light emitted by LED 24. The amount of light sensed by photodiode 28 is processed as follows by the electronic circuitry of the smoke detector system.

Figure 6:
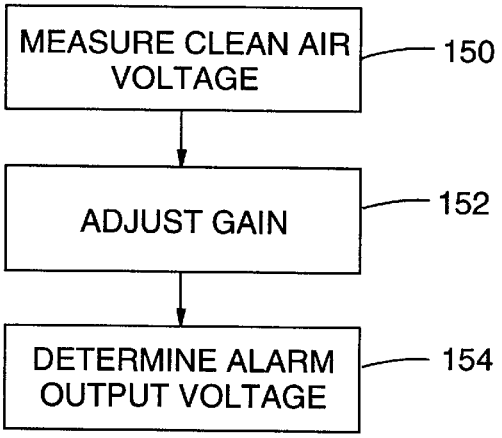
FIG. 6 is a flow diagram showing the steps performed in the factory during calibration of the smoke detector system.

The self-diagnostic capability of the smoke detector system of the invention stems from determining during calibration certain operating parameters of the optical sensor electronics. FIG. 6 is a flow diagram showing the steps performed during calibration in the factory.

With reference to FIG. 6, process block 150 indicates in the absence of a simulated smoke environment the measurement of a clean air voltage that represents a 0 percent smoke obscuration level. In a preferred embodiment, the clean air voltage is 0.6 volt. Upper and lower tolerance threshold limits for the clean air voltage are also set at nominally ±42 percent of the clean air voltage measured at calibration.

Process block 152 indicates the adjustment of the gain of the optical sensor electronics. This is accomplished by placing housing 10 in a chamber filled with an aerosol spray to produce a simulated smoke environment at a calibrated level of smoke obscuration. The simulated smoke particles flow through apertures 72 of canopy 14 and reflect toward photodiode 28 a portion of the light emitted by LED 24. Because the number of simulated smoke particles is constant, photodiode 28 produces a constant output voltage in response to the amount of light reflected. The gain of the optical sensor electronics is adjusted by varying the length of time they sample the output voltage of photodiode 28. In a preferred embodiment, a variable integrating analog-to-digital converter, whose operation is described below with reference to FIGS. 8 and 9, performs the gain adjustment by determining an integration time interval that produces an alarm voltage threshold of approximately 2.0 volts for a smoke obscuration level of 3.1 percent per foot.

Process block 154 indicates the determination of an alarm output voltage of photodiode 28 that produces an alarm signal indicative of the presence of an excessive number of smoke particles in a space where housing 10 has been placed. The alarm voltage of photodiode 28 is fixed and stored in an electrically erasable programmable read-only memory (EEPROM), whose function is described below with reference to FIG. 8.

Upon conclusion of the calibration process, the gain of the optical sensor electronics is set, and the alarm voltage and the clean air voltage and its upper and lower tolerance limit voltages are stored in the EEPROM. There is a linear relationship between the sensor output voltage and the level of obscuration, which relationship can be expressed as $$y=m*x+b,$$

where y represents the sensor output voltage, m represents the gain, and b represents the clean air voltage.

The gain is defined as the sensor output voltage per percent obscuration per foot; therefore, the gain is unaffected by a build-up of dust or other contaminants. This property enables the self-diagnostic capabilities implemented in the present invention.

The build-up of dust or other contaminants causes the ambient clean air voltage to rise above or fall below the nominal clean air voltage stored in the EEPROM. Whenever the clean air voltage measured by photodetector 28 rises, the smoke detector system becomes more sensitive in that it will produce an alarm signal at a smoke obscuration level that is less than the nominal value of 3.1 percent per foot. Conversely, whenever the clean air voltage measured by photodiode 28 falls below the clean air voltage measured at calibration, the smoke detector system will become less sensitive in that it will produce an alarm signal at a smoke obscuration level that is greater than the nominal value.

Figure 7:
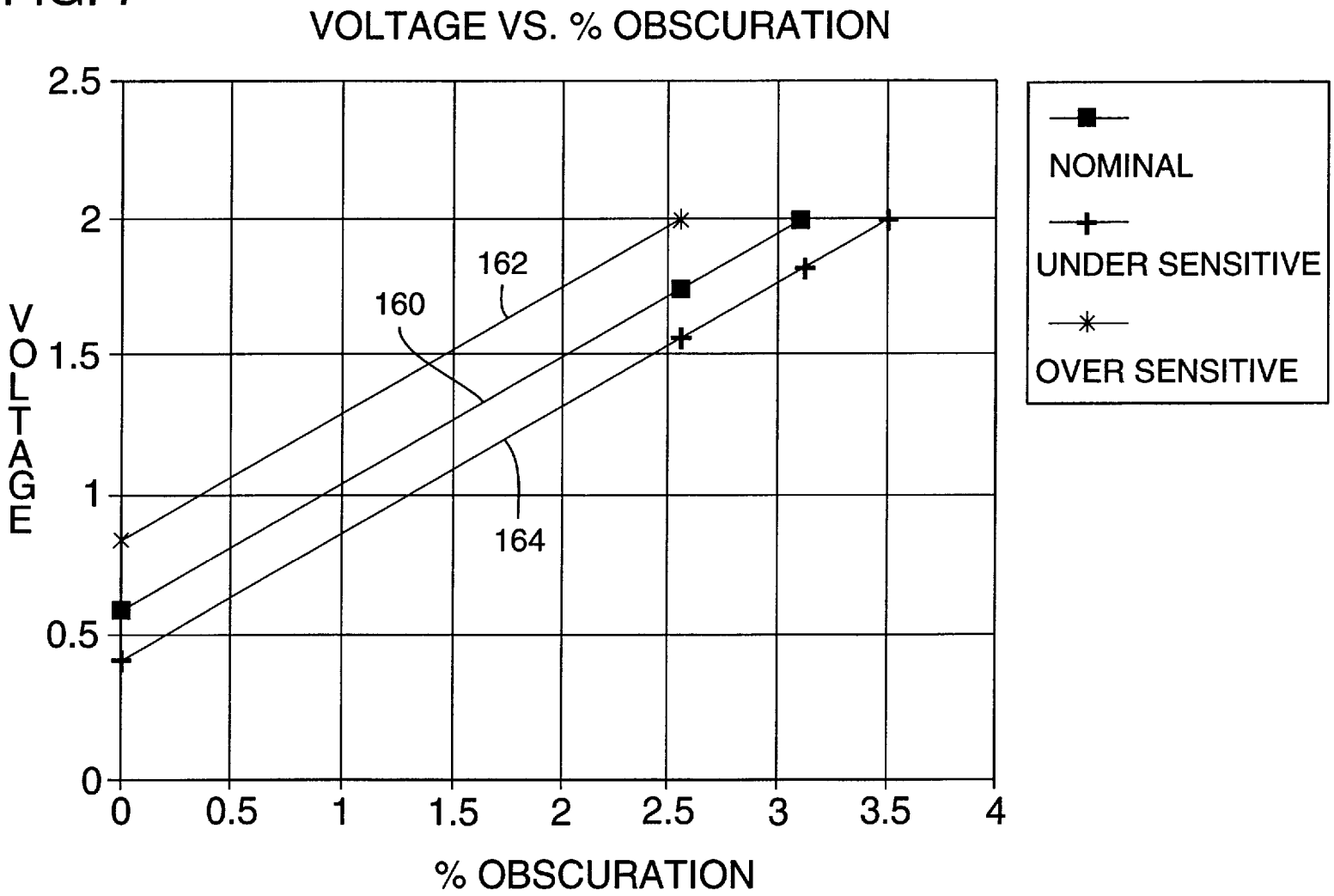
FIG. 7 is a graph of the optical sensor electronics sensitivity, which is expressed as a linear relationship between the level of obscuration and sensor output voltage.

FIG. 7 shows that changes in the clean air voltage measured over time does not affect the gain of the optical sensor electronics. Straight lines 160, 162, and 164 represent, respectively, nominal, over-sensitivity, and under-sensitivity conditions. There is, therefore, a direct correlation between a change in clean air voltage and a change in sensitivity to an alarm condition. By setting tolerance limits on the amount of change in voltage measured in clean air, the smoke detector system can indicate when it has become under-sensitive or over-sensitive in its measurement of ambient smoke obscuration levels.

To perform self-diagnosis to determine whether an under- or over-sensitivity condition or an alarm condition exists, the smoke detector system periodically samples the ambient smoke levels. To prevent short-term changes in clean air voltage that do not represent out-of-sensitivity indications, the present invention includes a microprocessor-based circuit that is implemented with an algorithm to determine whether the clean air voltage is outside of predetermined tolerance limits for a preferred period of approximately 27 hours. The microprocessor-based circuit and the algorithm implemented in it to perform self-diagnosis is described with reference to FIGS. 8–10.

Figure 8:
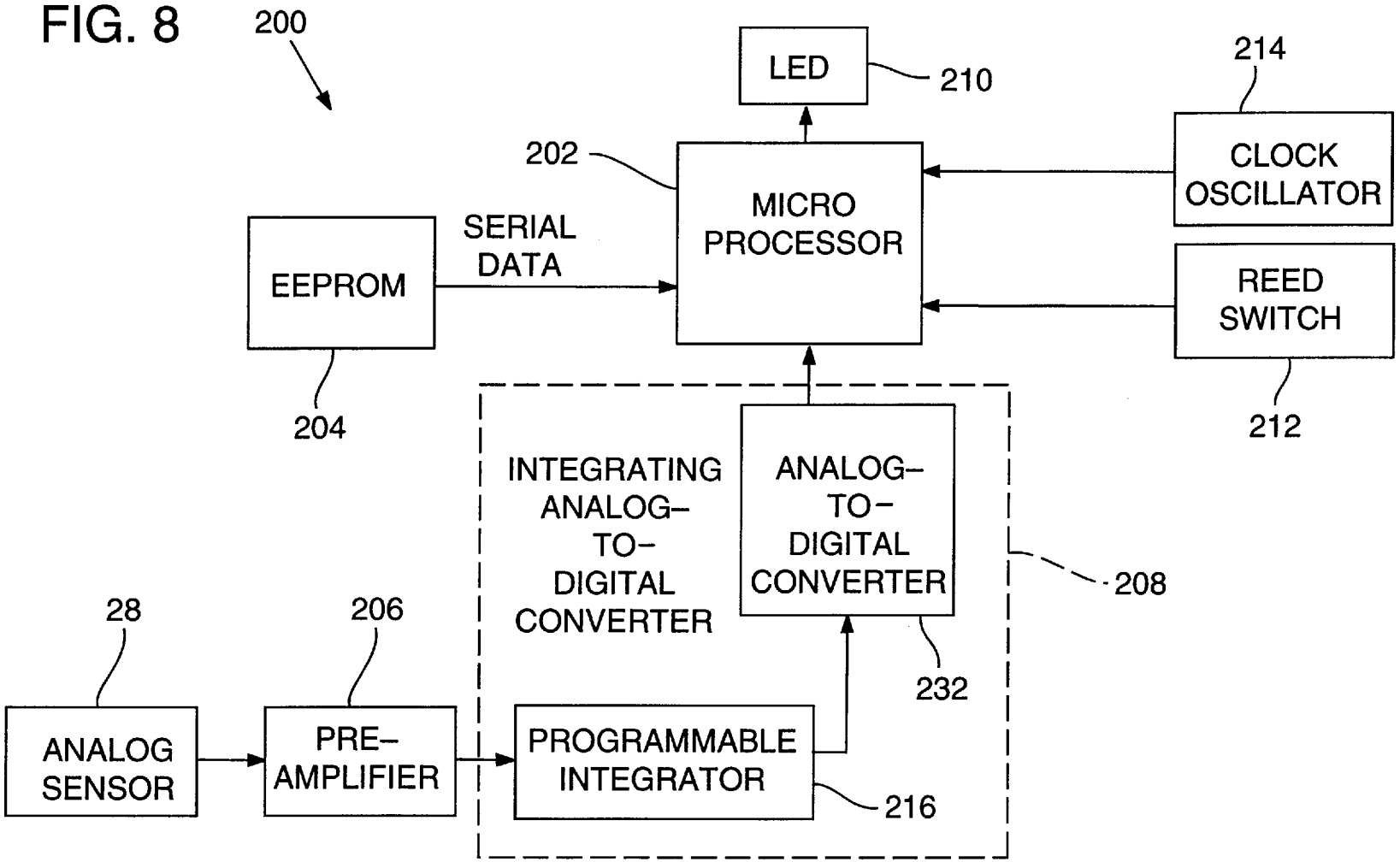
FIG. 8 is a general block diagram of the microprocessor-based circuit that implements the self-diagnostic and calibration functions of the smoke detector system.

FIG. 8 is a general block diagram of a microprocessor-based circuit 200 in which the self-diagnostic functions of the smoke detector system are implemented. The operation of circuit 200 is controlled by a microprocessor 202 that periodically applies electrical power to photodiode 28 to sample the amount of smoke present. Periodic sampling of the output voltage of photodiode 28 reduces electrical power consumption. In a preferred embodiment, the output of photodiode 28 is sampled for 0.4 milliseconds every nine seconds. Microprocessor 202 processes the output voltage samples of photodiode 28 in accordance with instructions stored in an EEPROM 204 to determine whether an alarm condition exists or whether the optical electronics are within preassigned operational tolerances.

Each of the output voltage samples of photodiode 28 is delivered through a sensor preamplifier 206 to a variable integrating analog-to-digital converter subcircuit 208. Converter subcircuit 208 takes an output voltage sample and integrates it during an integration time interval set during the gain calibration step discussed with reference to process block 152 of FIG. 6. Upon conclusion of each integration time interval, subcircuit 208 converts to a digital value the analog voltage representative of the photodetector output voltage sample taken.

Microprocessor 202 receives the digital value and compares it to the alarm voltage and sensitivity tolerance limit voltages established and stored in EEPROM 204 during calibration. The processing of the integrator voltages presented by subcircuit 208 is carried out by microprocessor 202 in accordance with an algorithm implemented as instructions stored in EEPROM 204. The processing steps of this algorithm are described below with reference to FIG. 10. Microprocessor 202 causes continuous illumination of a visible light-emitting diode (LED) 210 to indicate an alarm condition and performs a manually operated self-diagnosis test in response to an operator's activation of a reed switch 212. A clock oscillator 214 having a preferred output frequency of 500 kHz provides the timing standard for the overall operation of circuit 200.

Figure 9:
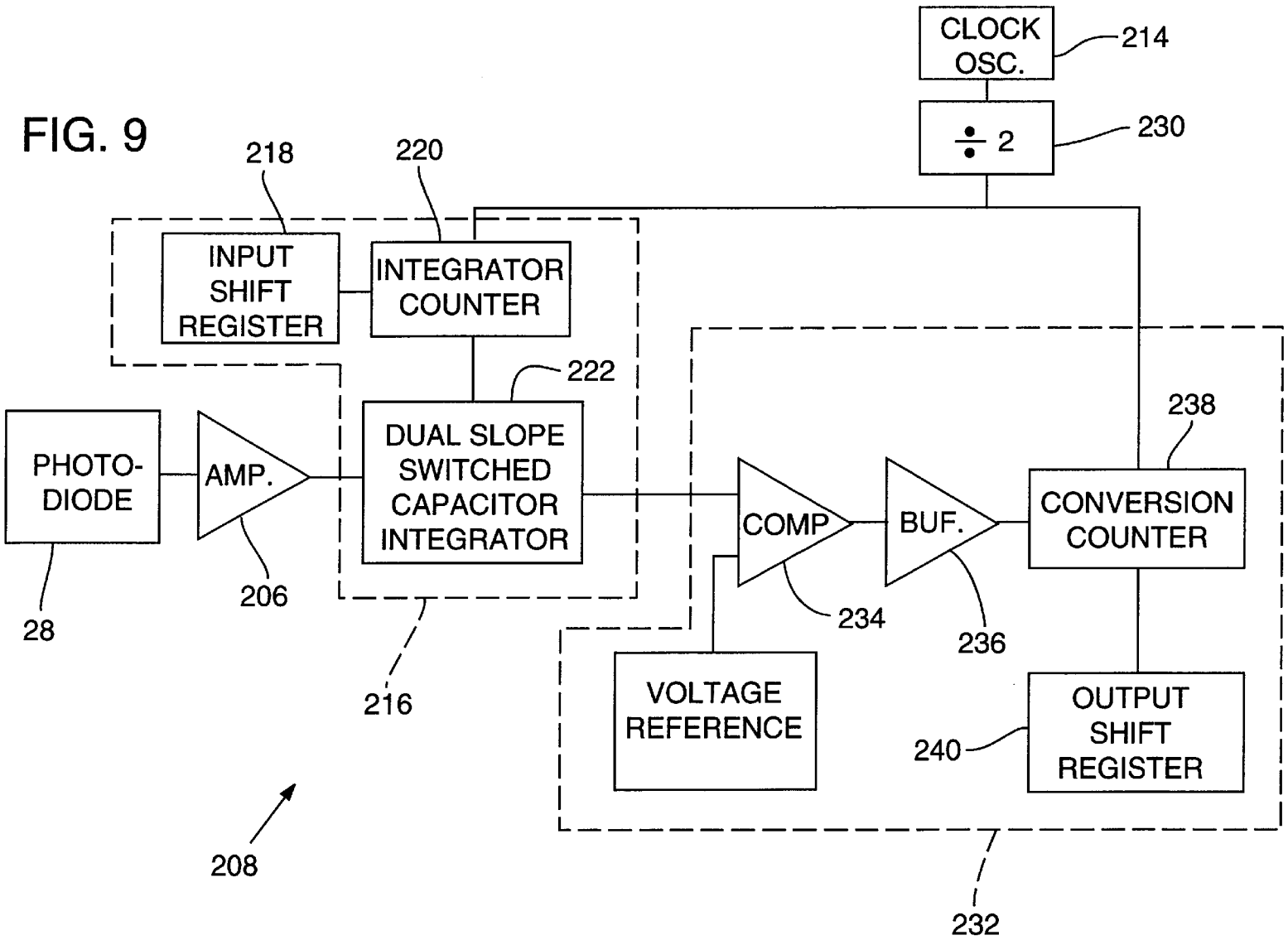
FIG. 9 is a block diagram showing in greater detail the variable integrating analog-to-digital converter shown in FIG. 8.

FIG. 9 shows in greater detail the components of variable integrating analog-to-digital converter subcircuit 208. The following is a description of operation of converter subcircuit 208 with particular focus on the processing it carries out during calibration to determine the integration time interval.

With reference to FIGS. 8 and 9, preamplifier 206 conditions the output voltage samples of photodetector 28 and delivers them to a programmable integrator 216 that includes an input shift register 218, an integrator up-counter 220, and a dual-slope switched capacitor integrator 222. During each 0.4 millisecond sampling period, an input capacitor of integrator 222 accumulates the voltage appearing across the output of preamplifier 206. Integrator 222 then transfers the sample voltage acquired by the input capacitor to an output capacitor.

At the start of each integration time interval, shift register 218 receives under control of microprocessor 202 an 8-bit serial digital word representing the integration time interval. The least significant bit corresponds to 9 millivolts, with 2.3 volts representing the full scale voltage for the 8-bit word. Shift register 218 provides as a preset to integrator up-counter 220 the complement of the integration time interval word. A 250 kHz clock produced at the output of a divide-by-two counter 230 driven by 500 kHz clock oscillator 214 causes integrator up-counter 220 to count up to zero from the complemented integration time interval word. The time during which up-counter 220 counts defines the integration time interval during which integrator 222 accumulates across an output capacitor an analog voltage representative of the photodetector output voltage sample acquired by the input capacitor. The value of the analog voltage stored across the output capacitor is determined by the output voltage of photodiode 28 and the number of counts stored in integrator counter 220.

Upon completion of the integration time interval, integrator up-counter 220 stops counting at zero. An analog-to-digital converter 232 then converts to a digital value the analog voltage stored across the output capacitor of integrator 222. Analog-to-digital converter 232 includes a comparator amplifier 234 that receives at its noninverting input the integrator voltage across the output capacitor and at its inverting input a reference voltage, which in the preferred embodiment is 300 millivolts, a system virtual ground. A comparator buffer amplifier 236 conditions the output of comparator 234 and provides a count enable signal to a conversion up-counter 238, which begins counting up after integrator up-counter 220 stops counting at zero and continues to count up as long as the count enable signal is present.

During analog to digital conversion, integrator 222 discharges the voltage across the output capacitor to a third capacitor while conversion up-counter 238 continues to count. Such counting continues until the integrator voltage across the output capacitor discharges below the +300 millivolt threshold of comparator 234, thereby causing the removal of the count enable signal. The contents of conversion up-counter 238 are then shifted to an output shift register 240, which provides to microprocessor 202 an 8-bit serial digital word representative of the integrator voltage for processing in accordance with the mode of operation of the smoke detector system. Such modes of operation include calibration, in-service self-diagnosis, and self-test.

During calibration, the smoke detector system determines the gain of the optical sensor electronics by substituting trial integration time interval words of different weighted values as presets to integrator up-counter 220 to obtain the integration time interval necessary to produce the desired alarm voltage for a known smoke obscuration level. As indicated by process block 154 of FIG. 6, a preferred desired alarm voltage of about 2.0 volts for a 3.1 percent per foot obscuration level is stored in EEPROM 204. The output of photodiode 28 is a fixed voltage when housing 10 is placed in an aerosol spray chamber that produces the 3.1 percent per foot obscuration level representing the alarm condition. Because different photodiodes 28 differ somewhat in their output voltages, determining the integration time interval that produces an integrator voltage equal to the alarm voltage sets the gain of the system. Thus, different counting time intervals for integrator up-counter 220 produce different integrator voltages stored in shift register 240.

The process of providing trial integration time intervals to shift register 218 and integrator up-counter 220 during calibration can be accomplished using a microprocessor emulator with the optical sensor electronics placed in the aerosol spray chamber. Gain calibration is complete upon determination of an integration time interval word that produces in shift register 240 an 8-bit digital word corresponding to the alarm voltage. The integration time interval word is stored in EEPROM 204 as the gain factor.

It will be appreciated that the slope of the integration time interval changes during acquisition of output voltage samples for different optical sensors but that the final magnitude of the output voltage of integrator 222 is dependent upon the input voltage and integration time. The slope of the analog-to-digital conversion is, however, always the same. This is the reason why integrator 222 is designated as being of a dual-slope type.

FIG. 10 is a flow diagram showing the self-diagnosis processing steps the smoke detector system carries out during in-service operation.

With reference to FIGS. 8–10, process block 250 indicates that during in-service operation, microprocessor 202 causes application of electrical power to LED 24 in intervals of 9 seconds to sample its output voltage over the previously determined integration time interval stored in EEPROM 204. The sampling of every 9 seconds reduces the steady-state electrical power consumed by circuit 100.

Process block 252 indicates that after each integration time interval, microprocessor 202 reads the just acquired integrator voltage stored in output shift register 240. Process block 254 indicates the comparison by microprocessor 202 of the acquired integrator voltage against the alarm voltage and against the upper and lower tolerance limits of the clean air voltage, all of which are preassigned and stored in EEPROM 204. These comparisons are done sequentially by microprocessor 202.

Decision block 256 represents a determination of whether the acquired integrator voltage exceeds the stored alarm voltage. If so, microprocessor 202 provides a continuous signal to an alarm announcing the presence of excessive smoke, as indicated by process block 258. If not so, microprocessor 202 performs the next comparison.

Decision block 260 represents a determination of whether the acquired integrator voltage falls within the stored clean air voltage tolerance limits. If so, the smoke detector system continues to acquire the next output voltage sample of photodiode 28 and, as indicated by process block 262, a counter with a 2-count modulus monitors the occurrence of two consecutive acquired integrator voltages that fall within the clean air voltage tolerance limits. This counter is part of microprocessor 202. If not so, a counter is indexed by one count, as indicated by process block 264. However, each time two consecutive integrator voltages appear, the 2-count modulus counter resets the counter indicated by process block 264.

Decision block 266 represents a determination of whether the number of counts accumulated in the counter of process block 264 exceeds 10,752 counts, which corresponds to consecutive integrator voltage samples in out-of-tolerance limit conditions for each of 9 second intervals over 27 hours. If so, microprocessor 202 provides a low duty-cycle blinking signal to LED 210, as indicated in process block 268. Skilled persons will appreciate that other signaling techniques, such as an audible alarm or a relay output, may be used. The blinking signal indicates that the optical sensor electronics have changed such that the clean air voltage has drifted out of calibration for either under- or over-sensitivity and need to be attended to. If the count in the counter of process block 264 does not exceed 10,752 counts, the smoke detector system continues to acquire the next output voltage sample of photodiode 28.

The self-diagnosis algorithm provides, therefore, a rolling 27-hour out-of-tolerance measurement period that is restarted whenever there are two consecutive appearances of integrator voltages within the clean air voltage tolerance limits. The smoke detector system monitors its own operational status, without a need for manual evaluation of its internal functional status.

Reed switch 212 is directly connected to microprocessor 202 to provide a self-test capability that together with the labyrinth passageway design of pegs 80 in canopy 14 permits on-site verification of an absence of an unserviceable hardware fault. To initiate a self-test, an operator holds a magnet near housing 10 to close reed switch 212. Closing reed switch 212 activates a self-test program stored in EEPROM 204. The self-test program causes microprocessor 202 to apply a voltage to photodiode 28, read the integrator voltage stored in output shift register 240, and compare it to the clean air voltage and its upper and lower tolerance limits in a manner similar to that described with reference to process blocks 250, 252, and 254 of FIG. 10. The self-test program then causes microprocessor 202 to blink LED 210 two or three times, four to seven times, or eight or nine times if the optical sensor electronics are under-sensitive, within the sensitivity tolerance limits, or over-sensitive, respectively. If none of the above conditions is met, LED 210 blinks one time to indicate an unserviceable hardware fault.

It will be obvious to those having skill in the art that many changes may be made to the details of the above-described preferred embodiment of the present invention without departing from the underlying principles thereof. For example, the system may use other than an LED a radiation source such as an ion particle or other source. The scope of the present invention should, therefore, be determined only by the following claims.

We claim:

1. A self-diagnostic smoke detector assembly, comprising:

a signal sampler cooperating with a radiation sensor to produce signal samples indicative of periodic measurements of a smoke obscuration level in a spatial region;

a smoke detector chamber including a base and a field replaceable optical block that are removably attachable to each other and when attached define an interior of the chamber into which smoke particles representing the smoke obscuration level enter, the base supporting the radiation sensor and the optical block including multiple elements that form low impedance labyrinthine passageways for smoke passing to the interior and direct spurious internally reflected light away from the radiation sensor;

a processor receiving and processing the signal samples, the processor comparing the signal samples to multiple threshold values, one of the threshold values representing a smoke obscuration alarm level and another of the threshold values representing a tolerance limit for the radiation sensor, and the processor determining from the signal samples corresponding to smoke obscuration levels that exceed the alarm level and from signal samples corresponding to smoke obscuration levels that exceed the tolerance limit whether the signal samples are indicative of an alarm condition or an out-of-calibration condition of the smoke detector assembly; and circuitry operatively associated with the processor for producing a tolerance limit signal in response to a determination by the processor whether the signal samples exceed the tolerance limit, the tolerance limit signal being a visible blinking light pulse sequence that changes to distinguish between in-calibration and out-of-calibration conditions of the smoke detector assembly.

2. The assembly of claim 1 in which the optical block has a periphery and each of the multiple elements has surfaces positioned near the periphery of the optical block to prevent external light infiltrating into the chamber from propagating along the labyrinthine passageways into the interior of the chamber.

3. The assembly of claim 1 in which the optical block has a periphery and the multiple elements are angularly spaced around the periphery.

4. The assembly of claim 1 in which the optical block has a surface with a boundary that defines a periphery of the optical block, the multiple elements depending in the same direction from the surface and being angularly spaced around the periphery.

5. The assembly of claim 4 in which the multiple elements and the surface of the optical block are a unitary article molded from the same plastic material.

6. A self-diagnostic smoke detector assembly, comprising:

a signal sampler cooperating with a radiation sensor to produce signal samples indicative of periodic measurements of a smoke obscuration level in a spatial region;

a processor receiving and processing the signal samples, the processor comparing the signal samples to multiple threshold values, one of the threshold values representing a smoke obscuration alarm level and another of the threshold values representing a tolerance limit for the radiation sensor, and the processor determining from the signal samples corresponding to smoke obscuration levels that exceed the alarm level and from signal samples corresponding to smoke obscuration levels that exceed the tolerance limit whether the signal samples are indicative of an alarm condition or an out-of-calibration condition of the smoke detector assembly; and self-test circuitry operatively associated with the processor for producing in response to an inquiry provided to the smoke detector assembly an indicator signal whenever an out-of-calibration condition exists, the self-test circuitry including memory sites storing a self-test procedure that the self-test circuitry carries out in response to the inquiry, and the indicator signal providing quantitative representations for multiple undersensitive out-of-calibration conditions and multiple oversensitive out-of-calibration conditions of the smoke detector assembly.

7. The assembly of claim 6, further comprising a housing and in which the inquiry provided to the smoke detector assembly is accomplished by manual placement of a magnet near the housing to cause the self-test circuitry to carry out a self-test procedure.

8. The assembly of claim 7, further comprising a reed switch that changes an electrical switching condition in response to the manual placement of the magnet near the housing.

9. The assembly of claim 6 in which the indicator signal is operatively coupled to a visible light indicator that provides different sequences of blinking light pulses in response to different ones of the undersensitive and oversensitive out-of-calibration conditions represented by the indicator signal.

10. The assembly of claim 9, further comprising a housing and in which the visible light indicator is a single light-emitting device that emits light from the housing.

11. The assembly of claim 10 in which the single light-emitting device is a light-emitting diode (LED).

12. A self-diagnostic smoke detector assembly, comprising:

a signal sampler cooperating with a radiation sensor to produce signal samples indicative of periodic measurements of a smoke obscuration level in a spatial region, consecutive ones of the signal samples being separated by a maximum sample time interval;

a processor receiving and processing the signal samples, the processor comparing the signal samples to multiple threshold values, one of the threshold values representing a smoke obscuration alarm level and another of the threshold values representing a tolerance limit for the radiation sensor, and the processor determining from the signal samples corresponding to smoke obscuration levels that exceed the alarm level and from signal samples corresponding to smoke obscuration levels that exceed the tolerance limit whether the signal samples are indicative of an alarm condition or an out-of-calibration condition of the smoke detector assembly; and a delay timer characterized by an out-of-calibration measurement period that is long relative to the maximum sample time interval, the delay timer producing an out-of-calibration indicator signal after the occurrence of a number of signal samples indicative of an out-of-calibration condition for a time equal to the out-of-calibration measurement period.

13. The assembly of claim 12 in which the maximum sample time interval is in the order of seconds and the out-of-calibration measurement period is in the order of hours.

14. The assembly of claim 12 in which the delay timer begins timing in response to a signal sample that falls outside the tolerance limit and ends timing before conclusion of the out-of-calibration measurement period in response to occurrences of successive signal samples that fall within the tolerance limit.

15. The assembly of claim 12 in which the delay timer includes a first counter that accumulates counts representing successive signal samples in the out-of-calibration condition, the first counter resetting the delay timer whenever there is absent a predetermined number of consecutive signal samples in the out-of-calibration condition.

16. The assembly of claim 12 in which the processor produces an indicator signal to enunciate the existence of an out-of-calibration condition.

17. The assembly of claim 12 in which the radiation sensor produces a sensor signal and in which the signal sampler includes a signal integrator that integrates a sample of the sensor signal over an integration time interval to produce a corresponding signal sample for comparison to the threshold values.

18. The assembly of claim 17, further comprising an analog-to-digital converter cooperating with the integrator to provide a digital signal corresponding to the sensor signal produced by the radiation sensor.

19. The assembly of claim 12 in which the delay timer includes a second counter that accumulates counts representing successive signal samples in the out-of-calibration condition during the out-of-calibration measurement period.

20. The assembly of claim 19 in which the counts accumulated by the second counter represent consecutive signal samples in the out-of-calibration condition.

21. A self-diagnostic smoke detector assembly, comprising:

a signal sampler cooperating with a radiation sensor to produce signal samples indicative of periodic measurements of a smoke obscuration level in a spatial region;

a processor receiving and processing the signal samples, the processor comparing the signal samples to multiple threshold values, one of the threshold values representing a smoke obscuration alarm level and another of the threshold values representing a tolerance limit for the radiation sensor, and the processor determining from the signal samples corresponding to smoke obscuration levels that exceed the alarm level and from signal samples corresponding to smoke obscuration levels that exceed the tolerance limit whether the signal samples are indicative of an alarm condition or an out-of-calibration condition of the smoke detector assembly; and a smoke detector chamber including a base and a field replaceable optical block that are removably attachable to each other and when attached define an interior of the chamber into which smoke particles representing the smoke obscuration level enter, the base supporting the radiation sensor and the optical block including multiple elements that form low impedance labyrinthine passageways for smoke passing to the interior and direct spurious internally reflected light away from the radiation sensor.

22. The assembly of claim 21 in which the optical block has a periphery and each of the multiple elements has surfaces positioned near the periphery of the optical block to prevent external light infiltrating into the chamber from propagating along the labyrinthine passageways into the interior of the chamber.

23. The assembly of claim 21 in which the radiation sensor supported by the base includes a radiation emitter and a radiation detector each of which having a line of sight, the lines of sight intersecting to form an angle between them.

24. The assembly of claim 21 in which the optical block has a periphery and the labyrinthine passageways receive smoke particles passing through openings at the periphery, the openings being sufficiently small to function as an insect screen.

25. The assembly of claim 21 in which the optical block has a periphery and the multiple elements are angularly spaced around the periphery.

26. The assembly of claim 25 in which the optical block is of cylindrical shape.

27. The assembly of claim 21 in which the optical block has a surface with a boundary that defines a periphery of the optical block, the multiple elements depending in the same direction from the surface and being angularly spaced around the periphery.

28. The assembly of claim 27 in which the multiple elements and the surface of the optical block are a unitary article molded from the same plastic material.

29. The assembly of claim 21 in which consecutive ones of the signal samples are separated by a maximum sample time interval and further comprising:

a delay timer characterized by an out-of-calibration measurement period that is long relative to the maximum sample time interval, the delay timer producing an out-of-calibration indicator signal after the occurrence of a number of signal samples indicative of an out-of-calibration condition for a time longer than the out-of-calibration measurement period.

30. The assembly of claim 29 in which the maximum sample time interval is in the order of seconds and the out-of-calibration measurement period is in the order of hours.

31. The assembly of claim 29 in which the delay timer begins timing in response to a signal sample that falls outside the tolerance limit and ends timing before conclusion of the out-of-calibration measurement period in response to occurrences of successive signal samples that fall within the tolerance limit.

32. The assembly of claim 21, further comprising self-test circuitry operatively associated with the processor for producing in response to an inquiry provided to the smoke detector assembly an indicator signal whenever an out-of-calibration condition exists, the indicator signal providing quantitative representations of undersensitive and oversensitive out-of-calibration conditions of the smoke detector assembly.

33. The assembly of claim 32 in which the indicator signal is operatively coupled to a visible light indicator that provides different sequences of blinking light pulses in response to the undersensitive and oversensitive out-of-calibration conditions represented by the indicator signal.

34. The assembly of claim 33, further comprising a housing and in which the visible light indicator is a single light-emitting device that emits light from the housing.

* * * * *

UNITED STATES PATENT AND TRADEMARK OFFICE

CERTIFICATE OF CORRECTION

PATENT NO. : 5,821,866

DATED : October 13, 1998

INVENTOR(S) : BRIAN ANDREW BERNAL, ROBERT GERARD FISCHETTE, KIRK RODNEY JOHNSON, and DOUGLAS HENRY MARMAN It is certified that error appears in the above-indentified patent and that said Letters Patent is hereby corrected as shown below:

Column 2, line 64, delete "[tab]" before --FIG. 1--.

Column 3, line 44, change "120° ." to --120°.--.

Column 5, line 9, change "exam" to --part--.

Signed and Sealed this

Seventeenth Day of August, 1999

*Attest:*

*Attesting Officer*

Q. TODD DICKINSON

*Acting Commissioner of Patents and Trademarks*